United States Patent [19]

Hauers et al.

[11] Patent Number: 4,524,566

[45] Date of Patent: Jun. 25, 1985

[54] PACKAGING MACHINE

[75] Inventors: Manfred Hauers, Viersen; Walter Baur, Gründau, both of Fed. Rep. of Germany

[73] Assignee: Rovema Verpackungsmaschinen GmbH & Co. KG, Fernwald, Fed. Rep. of Germany

[21] Appl. No.: 361,171

[22] Filed: Mar. 24, 1982

[30] Foreign Application Priority Data

Apr. 1, 1981 [DE] Fed. Rep. of Germany ..... 3113045

[51] Int. Cl.[3] ..... B65B 35/24; B65B 35/44

[52] U.S. Cl. ..... 53/534; 53/245; 53/247; 53/251; 53/255; 53/168; 53/542

[58] Field of Search ..... 53/534, 542, 168, 244, 53/245, 246, 247, 249, 251, 255

[56] References Cited

U.S. PATENT DOCUMENTS

| | | | |
|---|---|---|---|
| 405,088 | 6/1889 | Ferguson | 198/447 |
| 2,959,269 | 11/1960 | Kammerer | 198/447 |
| 3,335,542 | 8/1967 | Luxemborg | 53/247 |
| 3,353,331 | 11/1967 | Rowekamp | 53/249 |
| 3,407,916 | 10/1968 | Engeler | 198/24 |
| 3,613,911 | 10/1971 | Walchhuter | 53/246 X |
| 3,932,982 | 1/1976 | Klapp | 53/244 |

FOREIGN PATENT DOCUMENTS

| | | | |
|---|---|---|---|
| 1924949 | 8/1970 | Fed. Rep. of Germany | 53/537 |
| 2354577 | 6/1974 | Fed. Rep. of Germany | 53/542 |

*Primary Examiner*—John Sipos
*Assistant Examiner*—Donald R. Studebaker
*Attorney, Agent, or Firm*—Flynn, Thiel, Boutell & Tanis

[57] ABSTRACT

A packaging machine includes a magazine which has a plurality of vertical compartments open at the top and bottom and which is supported for steplike movement between first and second positions in a direction forming an acute angle to a horizontal reference. A pair of adjacent box supports are located below and are parallel to the path of movement of the magazine, and are vertically movable between positions closely adjacent and spaced from the bottom of the magazine. A feed mechanism supplies individual packages to a fixed location above the path of movement of the magazine, the packages dropping into respective magazine compartments as the magazine moves. The feed mechanism can include a shaping mechanism at such fixed location to uniformly shape the individual packages. An inclined guideway supplies boxes to one of the box supports.

12 Claims, 5 Drawing Figures

PACKAGING MACHINE

FIELD OF THE INVENTION

This invention relates to a packaging machine for individual packages and, more particularly, to a machine for packing flexible packages such as tube bags which are manufactured of foil in a storage box, particularly a display box, including a feed mechanism for supplying the individual packages, a magazine with compartments for receiving the individual packages and an arrangement for moving the individual packages from the magazine to the storage box, the magazine compartments being constructed as chutes which are open on top and can be opened at the bottom, and wherein below the magazine is arranged a liftable and lowerable support for the storage box, the storage box being guided from below to the magazine by raising the support.

BACKGROUND OF THE INVENTION

Individual packages are supposed to be stored well-organized in a storage box in order to be able, as well as possible, to utilize the space which is available in the storage box. Storage boxes are often constructed as display boxes in which the individual packages are stored standing up. Such boxes are set up on shelves in self-service stores for the purpose of having buyers remove the individual packages. The orderly positioning of the individual packages in the storage box has thus the additional purpose of rendering the goods visually attractive.

In a conventional packaging machine of the above-mentioned type (German OS No. 1 932 852), the magazine compartments are the lower ends of turning channels. Such lower ends are closed off by a plate. When the magazine has been filled, the plate is pulled away after which the individual packages fall from the channels into the storage box. In this situation, the storage box is in an elevational position so that its upper edges lie just below the plate. The individual packages must thus, after exiting the magazine, go through a free fall the distance of such fall approximately equaling the height of the storage box. This can result in the individual packages not reaching the bottom of the storage box in the desired organized arrangement.

Also known is a device for inserting tube bags which contain a liquid, for example drinkable milk, into a storage box (German OS No. 1 924 949). The bags, which are filled by and come from a tube-bag machine, are tilted into a horizontal position and fall at the same time into a magazine, which is closed off at the bottom of flaps. When the entire magazine is filled, the flaps are pulled away laterally and the bags, which are in the magazine and can be provided in several layers in the magazine, fall in the horizontal position into the storage box. Here too it is possible that, during the free fall of the bags, undesired position changes occur. In both conventional devices, the closing flaps for the magazine compartments and the operating mechanism therefor involve considerable structural expense.

Finally, a system for the automatic introduction of tiles into boxes is known (German OS No. 2 354 577). The box is moved step-by-step on an inclined conveyor belt. The tiles are guided by means of conveyor belts from a substantially horizontal position into a substantially vertical position and are released by the conveyor belts shortly before reaching the box. The remainder of the travel thereof is a free fall. A magazine does not exist in this device. With this conventional device, however, only things of a solid design, for example tiles can be packaged in an organized manner, since flexible packages such as tube bags would assume an unorganized arrangement in the storage box.

A purpose of the present invention is to provide a packaging machine of the above-mentioned type with which flexible bags having an unstable filling can be introduced into and fully utilize the capacity of the storage box without having the individual packages go through a free fall after having been moved into the magazine.

SUMMARY OF THE INVENTION

This purpose is attained according to the invention by providing a machine of the foregoing type in which the storage box can be moved over the magazine and, in this moved-over position, closes off the bottoms of the magazine compartments.

In a thus constructed packaging machine, each bag is held in shape in a magazine compartment into which it falls. Since the bottom of the magazine is formed by the storage box, a free fall of the individual packages does not take place after the filling of the magazine; during lowering of the storage box after a complete filling of the magazine, the individual packages slide, due to the force of gravity, one of the magazine compartments and continue to be supported on the bottom of the storage box. This avoids the danger that the individual packages, which are organized in the magazine, become disorganized. The closing of the lower end of the magazine with the storage box also has the advantage that a special closing mechanism is not needed, which results in a particularly simple construction of the machine.

During the filling of the magazine, relative movement must be carried out between the magazine and the feed mechanism so that the compartments are filled one after the other. Particularly advantageous is a stationary arrangement of the feed mechanism in a step-by-step movement of the magazine relative thereto. The invention, however, also includes embodiments in which the relative movement is achieved in a different manner.

A particularly favorable sliding of the individual packages into the magazine compartments which does not stress the individual packages is achieved with a feed mechanism which has a curved end piece. An inclined arrangement of the magazine has the advantage that centrifugal forces produced during the deflection of the individual packages are counteracted by the force of gravity, and in this manner a lifting off of the individual packages from the guideway is safely avoided. The mentioned inclined position is structually easy to achieve if the entire machine is arranged inclined. The guiding is further improved if the curved end piece has a moving belt. With this, sliding movement which could stress the individual packages is avoided. Also, the conveying is independent of changing friction conditions.

According to an advantageous further development of the invention, a shaping mechanism is provided. With this, flexible bags can be shaped advantageously, for example, the bag content can be distributed uniformly over the bag length. Particularly effective is a shaping mechanism having a shaping roller. The possibility to vary the size of the passage of the shaping mechanism permits quick opening of the passage in the case of breakdowns in operation and also adjustment of the passage size to different conditions. Particularly advantageous is an arrangement in which the roller and associated passage walls are movably supported on a carriage.

An arrangement which has two synchronously operating magazines has the advantage that the individual packages can be supplied without interruption and without creating an accumulation. Namely, while one magazine is emptied by lowering the packaging container, the other magazine is being filled. This double arrangement, however, is not absolutely necessary since, with suitable devices, such as a storage arrangement in the feed mechanism, the interruption during emptying of the magazine and placement of an empty storage box can be bridged.

An advantageous total arrangement results with splitting of the box support. In this case, the feeding of empty boxes and removal of filled boxes can take place in the same plane, without the liftable and lowerable box support itself being movable with the magazine.

Another advantageous arrangement results where the storage boxes can be placed onto the box support without a lifting operation. A movable arrangement of the box support in connection with the use of only one lifting cylinder is a particularly simple and thus inexpensive construction which functions safely.

The feeding of empty storage boxes on an inclined guideway to a box support having a stop which halts the next box when the box support is raised is extremely simple, since no complex control device for supplying the empty storage boxes is needed. Namely, these are taken from an accumulation. The inclined position of the entire machine can be thus utilized.

BRIEF DESCRIPTION OF THE DRAWINGS

An exemplarly embodiment of the invention is illustrated in the drawings, in which.

DETAILED DESCRIPTION

Figure 1:
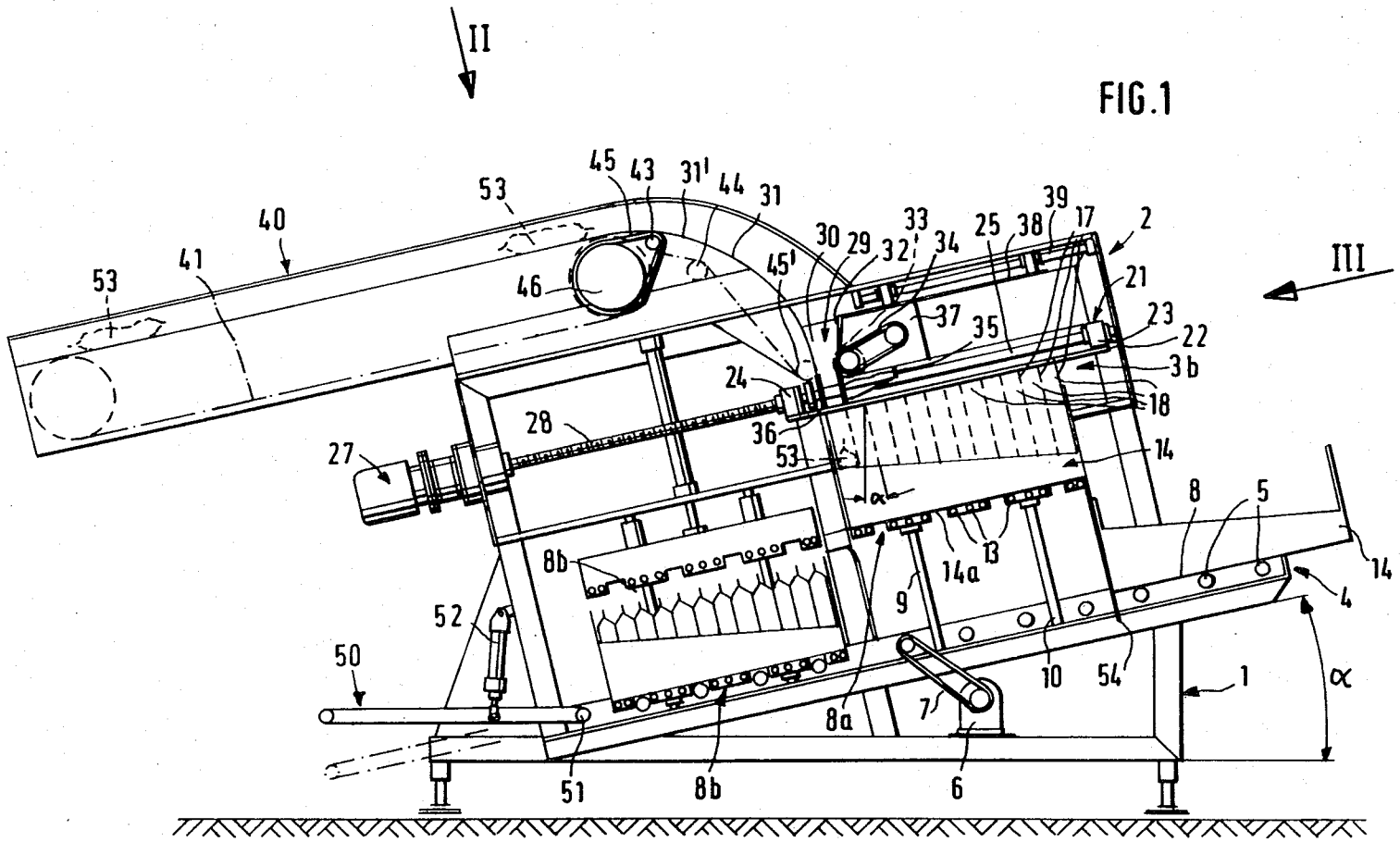
FIG. 1 is a sectional side view taken along the line I—I of FIG. 2 of a packaging machine.

The packaging machine of FIG. 1 has a base which as a whole is identified with reference numeral 1 and on which a machine frame which is identified as a whole with reference numeral 2 is arranged at an incline. The angle of inclination relative to a horizontal reference is identified with $\alpha$. $\alpha$ can be approximately 12.5°. Two magazines 3*a* and 3*b* (FIG. 2) are arranged in the machine frame 2, with which magazines diverse devices are associated. We thus deal with a double arrangement, so that the description of one half thereof is sufficient. These arrangements will be described hereinafter partly in connection with the arrangement associated with the magazine 3*a* and partly in connection with the arrangement associated with the magazine 3*b*.

A guideway 4 having rollers 5 is provided at the bottom of the machine frame 2. The rollers 5 can be driven with a geared motor 6 which is mounted on the base 1 and drives one of the rollers with a belt 7. The roller 5 are coupled to each other by belts 7' (FIG. 3) or chains. Extending parallel to the guideway 4 is a container or box support which is identified as a whole with reference numeral 8. The box support consists of two parts 8*a* and 8*b* which can be operated independently.

The part 8*a* is movable along two guide rods 9 and 10. Sleeves 11 (FIG. 3) are movable on the guide rods and are connected by a crossbeam 12. Rods 13 project self-supportingly from the crossbeam 12, which rods support the storage bins. For clarification, it is remarked that, since parts are cut away in FIG. 1, the rods 9 and 10 which are visible are associated with the box support associated with magazine 3*b*.

Figure 3:
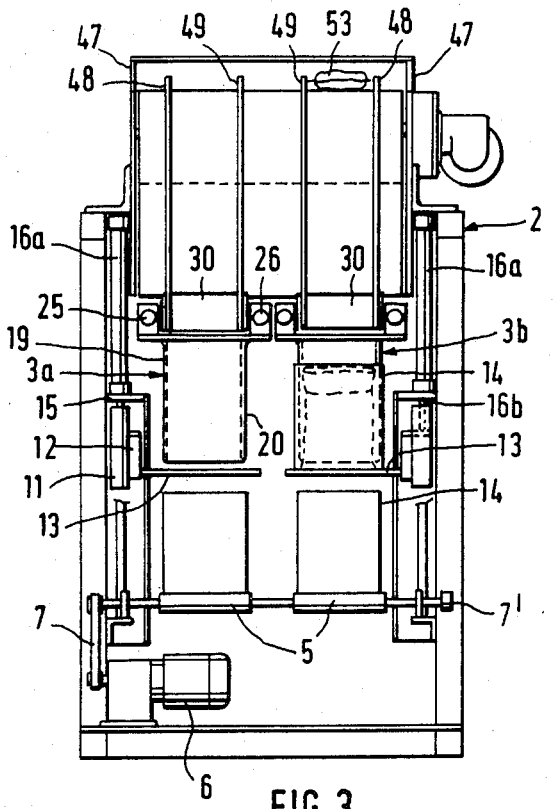
FIG. 3 is fragmentary end view of the machine of FIG. 1 taken in the direction of the arrow III of FIG. 1.

The guide rods 9 and 10 extend to a longitudinal crossbeam 15 which is arranged at approximately half the height of the machine frame 2. Above this longitudinal crossbeam is arranged the cylinder part 16*a* of a lifting cylinder, the piston rod 16*b* of which is connected to the crossbeam 12 which extends between the two guide sleeves 11. FIG. 3 identifies the piston rod 16*b* of only one arrangement.

With the help of the lifting cylinder 16*a*/16*b*, the part 8*a* of the box support can be moved to a raised position in which the rods 13 lie just below the magazine 3*a*, and to a lowered position in which the rods lie between the rollers 5. This lowered position is shown in FIG. 1 for the support part 8*b*. When both support parts 8*a* and 8*b* are raised, the rods 13 of both lie in a common plane.

The magazine 3*b* has a large number of parallel walls 17 (FIG. 1) which form parallel chutes 18. The walls 17 have a height greater than the walls of the container as shown in FIG. 1. These chutes are open at the top and bottom thereof. The walls 17 extend between side walls 19 and 20 (FIG. 3) at a right angle thereto. The magazine 36 is suspended from a carriage which is identified as a whole with reference numeral 21 (FIG. 1). The carriage has longitudinal crossbeams 22 and lateral crossbeams 23 and 24. Guide sleeves are provided on each of the lateral crossbeams 23 and 24 and can be moved along guide rods 25 and 26. The guide rods 25 and 26 extend the entire length of the machine frame 2.

The spindle motor 27 is secured on the left of the machine frame 2, from which motor projects a threaded spindle 28 which threadedly cooperates with the carriage 21. The spindle 28 extends parallel to the guide rods 25 and 26. Upon operation of the spindle motor, the carriage 21 is moved along the guide rods 25 and 26.

A shaping mechanism which is identified as a whole with reference numeral 29 is provided above the magazine 3*a*. The shaping mechanism has a downwardly tapering passage 20 which is defined on one side by a convexly curved guideway 31 and on the other side by a sheet-metal plate 32. Below the sheet-metal plate 32 is provided a shaping roller 33 which projects into the passage 30 and is driven by means of a belt 34. Below the roller 33 is provided a guide plate 35 which in FIG. 1 lies in a common plane with a partition wall 17 of the magazine 3*b*. A guide plate 36 is provided below the curved guideway 31 and is parallel to the adjacent end of the guideway. The distance between these sheet-metal plates 35 and 36 equals the width of a chute 8 in the magazine 3*a*.

The sheet-metal plates 35 and 32 and the shaping roller 33 and its drive mechanism are supported on a frame 37 which is connected to a carriage 38 which is movable on guide rods 39 provided on the machine frame 2.

A feed mechanism which as a whole is identified with reference numeral 40 is arranged on top of the machine frame. The feed mechanism 40 has a distributing belt 41, which can be driven by means of a geared motor 42 (see FIG. 2) At the inner end of the feed mechanism 40 is provided the already mentioned curved guideway section 31. Moveable along this curved guideway, which is a rigid support plate, is a belt 31' which is guided over rollers 43, 44 and 45' and can be driven by a driving belt 45 from a roller 46 which also serves to drive the belt 42. Thus, the belt 42 is also driven from the geared motor 42.

Figure 2:
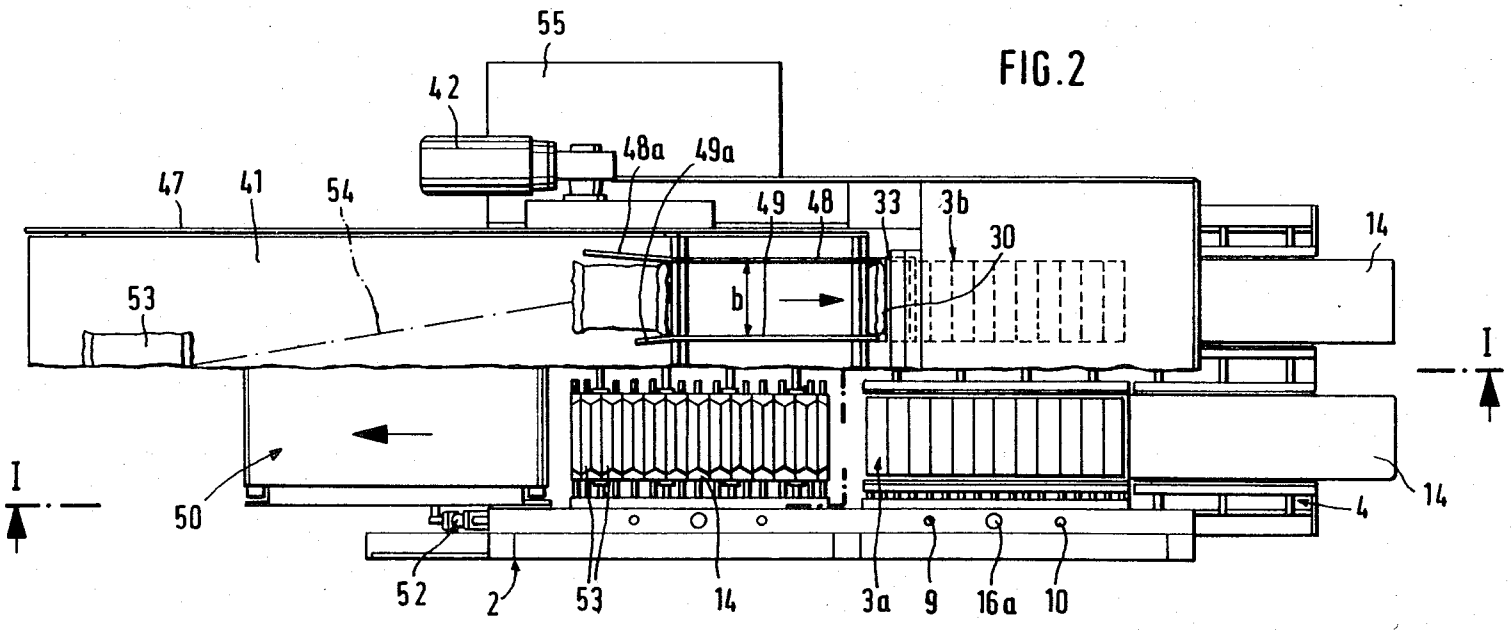
FIG. 2 is a fragmentary top view of the machine of FIG. 1 taken in the direction of the arrow II in FIG. 1.

A guide plate 47 is provided on each side of the belt 41. Further guide plates are arranged at the inner end of the feed mechanism 40. FIG. 2 illustrates two such further guide plates 48 and 49 which are associated with the magazine **3*b* and have a spacing b therebetween approximately equal to the width of one package. To make introduction of the individual packages between the sheet-metal plates 48 and 49 easier, their ends 48*a* and 49*a*** are bent to diverge.

A discharge belt identified as a whole with reference numeral 50 is also provided on the machine frame 2. The discharge belt 50 is supported on a frame which can be pivoted about a horizontal axis 51 by means of a fluid actuated cylinder 52. A horizontal position thereof is indicated with solid lines and an inclined position with dash-dotted lines.

The packaging machine operates as follows. The drawing illustrates the condition in which the filling of the magazines **3*b* has started and transporting of a storage box 14 which was previously filled in the magazine 3*a*** is taking place.

During the filling of the magazine **3*b*, the carriage 21 is moved step-by-step to the left by means of the spindle motor 27. These steps of movement are of a size so that each step brings a new magazine compartment 18 under the passage 30, namely, into alignment with the guide plates 35 and 36. As a result of such movement, the storage box 14 around magazine 36 is moved from the support part 8*a* onto the support part 8*b*. For clarification, it is remarked that respective support parts 8*a* and 8*b* are associated with each of the magazines 3*a* and 3*b*. At this stage, the support part 8*b* lies in the same inclined plane as the support part 8*a* which holds the container or box 14 against the magazine 3*b***.

The individual packages 53 are supplied on the feed mechanism 40 and are guided on the distributor belt 41 according to the dash-dotted line 54 (FIG. 2). They finally pass between the guide plates 48 and 49. The timed sequence in which the individual packages 53 are supplied is adjusted to the timed sequence of the movement of the magazines **3*a* and so that a package or bag 53 is not moved into the passage 30 before an empty compartment 18** has stopped under said package.

Often, the bags 53 are shaped irregularly during feeding, as is indicated by the illustration of the bags which lie on the belt 51. The bags are then changed to a uniform thickness by the shaping mechanism 29 so that they fit in the magazine compartments 18. The shaping is done on the one hand by increasing narrowness of the passage 30 and on the other hand by the shaping roller 33. The fill material is thereby evenly distributed over the entire length of the bag. The bags can thus be introduced into the magazine compartments 18 without any resistance worth mentioning. The curved belt 31' and the shaping roller 33 serve a driving function for the bag movement, so that the bags can also be moved into the magazine against some resistance.

The inclined position (angle $\alpha$) of the machine frame 2 also has the consequence that the compartments 18 lie at an angle so that a deflection of the bags 53 so as to be vertical is not necessary. Therefore, a gravitational force component remains until the introduction of the bags into the compartments 18, which component tries to hold the bags on the curved guideway 31. A lifting off from the guideway need therefore not be feared and safe sliding into the passage 30 takes place.

When the magazine **3*b* is completely filled, a further step of movement thereof takes place, through which the box 14 is moved completely off the support part 8*a* and onto the support part 8*b*. After this, the support part 8*b* is lowered and the individual packages 53, due to the force of gravity, slide out of the magazine compartments 18 which are open at the bottom. FIG. 1 illustrates a completely lowered box which was not filled in the magazine 3*b* but in the magazine 3*a***.

After the magazine **3*b* has been completely filled, the bags 53 are fed to the magazine 3*a* by the guide belt 41. This magazine is then already in the starting position for a new filling, is received within a container 14 a sufficient distance to cause the lower ends of the chutes to be closed off at the bottom by the bottom wall of the container 14. There now remains sufficient time for removing the filled box in the magazine 3*b*. Same is first moved onto the discharge belt 50. Furthermore, the magazine 3*b* is returned to its starting position for a new filling. After the filled box has been removed, the support part 8*b*** is again lifted.

Empty storage container or boxes 14 are supplied on the inclined guideway 4 by means of the force of gravity. The guideway 4, viewed in FIG. 1, extends farther to the right than is illustrated in the drawing. The boxes can move forward only to a stop 54A when the support part **8*a* is lifted, which stop projects downwardly from the support part 8*a*. When, however, the support part 8*a* is lowered, which is done for the purpose of supplying thereto an empty storage box 14, then the storage box can move onto the support part. This is facilitated by the transport rollers 5 of the guideway 4. The support rods 13 are, at this time, slightly below the contact plane defined by the tops of the transport rollers 5, so that they do not provide any resistance. In order to make the magazine which is in the starting position fillable, the empty container 14 is raised by means of the support part 8*a* and is thereby moved over the magazine, whereby bottom 14*a* of the box 14 closes off the bottoms of the chutelike magazine compartments 18. That is, and as shown in FIG. 1, the walls 17 of the magazine compartments extend a sufficient distance into the container 14 to cause the lower ends of the chutes to be closed off. The walls 17 provide continued and precision guidance for the individual packages or bags 53 until they rest on the bottom wall of the container 14**.

The double arrangement has the advantage that the supply of the individual packages 53 does not need to be interrupted since, during the unavoidable and relatively long time needed for emptying a magazine, returning it to the starting position and raising an empty box 14, it is possible to simultaneously pack individual packages into another box 14.

The control of the described function sequence is done by a control box 55, wherein conventional control techniques are utilized.

Figure 4:
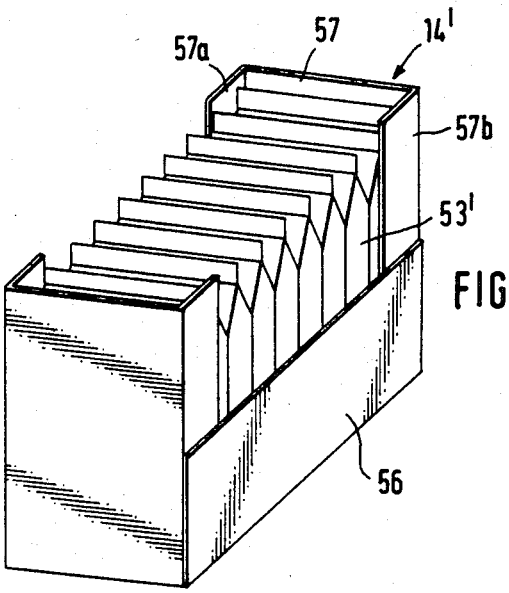
FIG. 4 is a perspective view of a storage bin which is utilized in conjunction with the machine of FIG. 1, is filled with individual packages and is constructed as a display box.

A storage box 14 is illustrated in FIGS. 1 and 2, the side walls of which are cut to be inclined. It would also be possible to use a storage box in the machine of the type illustrated in FIG. 4. This storage box, which is identified with reference numeral 14', has side walls 56 of a height which is constant over their entire length. The end walls 57 have bent edges 57*a* and 57*b*, which in the raised position of the box partially grip around the associated magazine. The box 14' is designated to receive ten individual packages 53' while the box illustrated in FIGS. 1 to 3 is designed for receiving twelve individual packages 53. The machine can, by exchanging the magazines 3*a* and 3*b* for similar units, easily be converted to handle a different number of individual packages per storage box.

Figure 5:
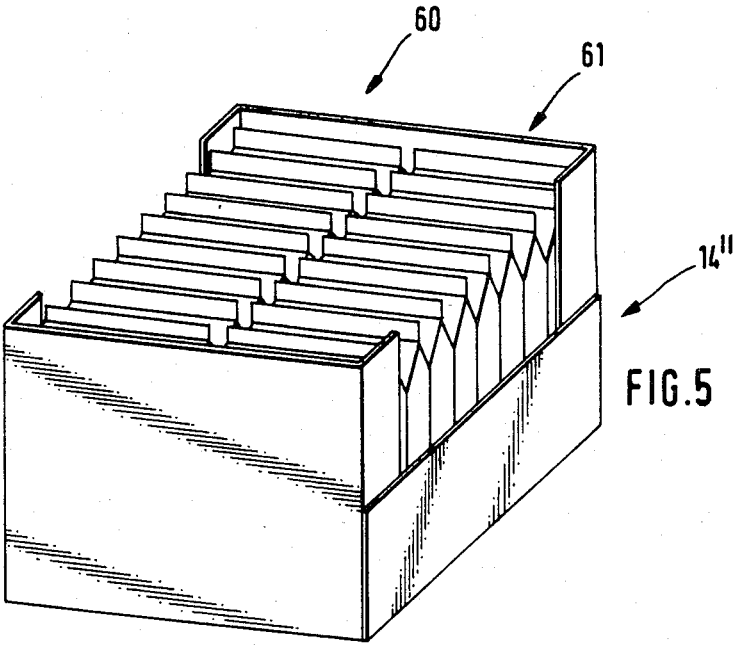
FIG. 5 is a perspective view of a display box which is similar to that of FIG. 4 but is filled with two rows of individual packages.

With a machine according to the principle of the invention, it is also possible to fill boxes 14" according to FIG. 5 with two rows 60 and 61 of individual packages, if each magazine is constructed with two rows of chutes.

The embodiments of the invention in which an exclusive property or privilege is claimed are defined as follows:

1. In a packaging machine for introducing individual packages into a container, including a feed mechanism for feeding the individual packages to means defining a passage, a magazine with plural compartments for receiving the individual packages therein and from said passage, said magazine compartments being constructed as chutes which are open on both top and bottom, means for moving said container to and from said magazine, said means for moving said container including a liftable and lowerable container support for said container being arranged below said magazine, said container being guided from below toward said magazine by raising said container support, the improvement comprising wherein said container is moved up to receive said magazine therein and to close off the bottom of said chutes, wherein support means are provided for supporting said feed mechanism and said magazine for relative movement with respect to each other, wherein said container support is divided into two support parts which can be raised and lowered independently, namely into a first support part which lies below said passage for said individual packages and a second support part adjacent the first support part, and wherein said container is moved, during the course of its being filled, from the first support part to the second support part.

2. The packaging machine according to claim 1, wherein said magazine compartments are defined by plural parallel walls, and wherein said feed mechanism has a curved end piece which transfers without sharp bends into the direction in which said walls of said magazine compartments extend.

3. The packaging machine according to claim 2, wherein said magazine is arranged inclined so that said walls of said compartments define an acute angle with a vertical plane.

4. The packaging machine according to claim 3, wherein said frame means, with the possible exception of a base therefor, is inclined so that it defines an acute angle with a horizontal plane.

5. The packaging machine according to claim 2, wherein said curved end piece of said feed mechanism is formed by a belt supported for movement in the same direction as the direction of movement of said individual packages.

6. The packaging machine according to claim 1, wherein intermediate said magazine and said feed mechanism, there is arranged a shaping mechanism which has a passage which converges in the conveying direction, the narrowest point of which has a width which is approximately equal to or less than the width of said magazine compartments.

7. The packaging machine according to claim 6, wherein said shaping mechanism has at least one rotating roller, which presses onto a side surface of each package.

8. The packaging machine according to claim 7, wherein said passage is limited on at least one side by walls which are supported for movement so that the width of said passage can be varied.

9. The packaging machine according to claim 8, wherein said roller is supported for movement together with said walls and wherein said walls and said roller together with its drive mechanism are arranged on a common carriage.

10. The packaging machine according to claim 1, wherein said feed mechanism has two feeding passages arranged side-by-side, wherein a switch arranged before said feeding passages directs individual packages which arrive over a common conveyor path selectively to one of said passages, and wherein each passage is associated with a magazine.

11. The packaging machine according to claim 3, wherein said acute angle is approximately 12.5°, the direction of inclination being such that the individual packages do not need to be deflected to a vertical direction.

12. The packaging machine according to claim 4, wherein said acute angle is approximately 12.5°.

* * * * *